US006198437B1

(12) United States Patent
Watson et al.

(10) Patent No.: US 6,198,437 B1
(45) Date of Patent: Mar. 6, 2001

(54) BROADBAND PATCH/SLOT ANTENNA

(75) Inventors: Paul M. Watson, Centerville, OH (US); Kuldip C. Gupta, Boulder, CO (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/350,222

(22) Filed: Jul. 8, 1999

Related U.S. Application Data

(60) Provisional application No. 60/092,230, filed on Jul. 9, 1998.

(51) Int. Cl.[7] ..... H01Q 1/38

(52) U.S. Cl. ..... 343/700 MS; 343/777; 343/846

(58) Field of Search ..... 343/700 MS, 767, 343/770, 769, 829, 846, 848, 849

(56) References Cited

U.S. PATENT DOCUMENTS

| | | | | |
|---|---|---|---|---|
| 4,063,246 | * | 12/1977 | Greiser | 343/700 MS |
| 4,131,894 | | 12/1978 | Schiavone . | |
| 4,170,013 | * | 10/1979 | Black | 343/700 MS |
| 4,443,802 | * | 4/1984 | Mayes | 343/729 |
| 4,864,314 | | 9/1989 | Bond . | |
| 4,873,529 | | 10/1989 | Gibson . | |
| 5,005,019 | * | 4/1991 | Zaghloul et al. | 343/700 MS |
| 5,025,264 | * | 6/1991 | Stafford | 343/767 |
| 5,087,920 | * | 2/1992 | Tsumaru et al. | 343/700 MS |
| 5,608,413 | | 3/1997 | Macdonald . | |
| 5,661,493 | | 8/1997 | Uher et al. . | |
| 5,668,558 | | 9/1997 | Hong . | |
| 5,777,581 | | 7/1998 | Lilly et al. . | |
| 5,818,391 | | 10/1998 | Lee . | |
| 5,864,123 | | 1/1999 | Keefer . | |
| 5,872,542 | | 2/1999 | Simons . | |
| 5,872,545 | | 2/1999 | Rammons . | |

OTHER PUBLICATIONS

P.M. Watson et al, "Knowledge Based EM–ANN Models for the Design of Wide Bandwidth CPW Patch/Slot Antennas",.

P.M. Watson et al, "EM–ANN Models for Design of CPW Patch Antennas", presented at the Institute of Electrical nd Electronic Engineers International Antenna and Propagation Symposium, Jun. 21–26, 1998, Atlanta, GA.

* cited by examiner

*Primary Examiner*—Tho Phan
(74) *Attorney, Agent, or Firm*—Gerald B. Hollins; Thomas L. Kundert

(57) ABSTRACT

A broadband microwave coplanar antenna suitable for use in singular antenna or antenna array dispositions in a plurality of military and other present day uses. The disclosed antenna combines desirable characteristic of the patch and slot antenna forms into an arrangement having both patch resonances and slot resonances. These resonances may be individually accessed and either combined in frequency location or dispersed in frequency to accomplish a broadband combination antenna characteristic. Broadband electrical impedance characteristics are also provided in the dispersed resonance arrangement. The antenna includes a coplanar ground plane member disposed surrounding the active patch/slot element with both physical dimensions of the active patch/slot element and spacings from the ground plane element determining the resonances.

18 Claims, 6 Drawing Sheets

| | |
|---|---|
| CENTER | 7.00 GHz |
| SPAN | 5.00 GHz |
| Marker 1 | 8.575 GHz, - 10.45dB |
| Marker 2 | 6.05 GHz, - 10.415dB |

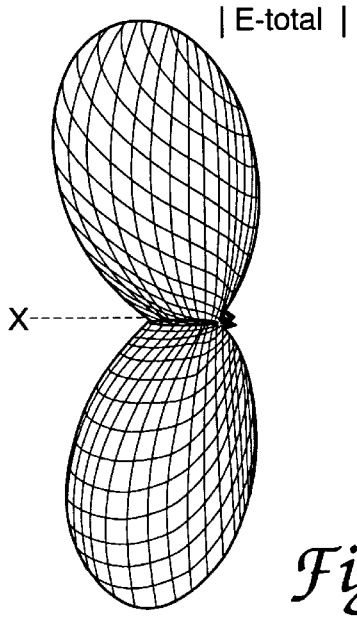
Fig. 4
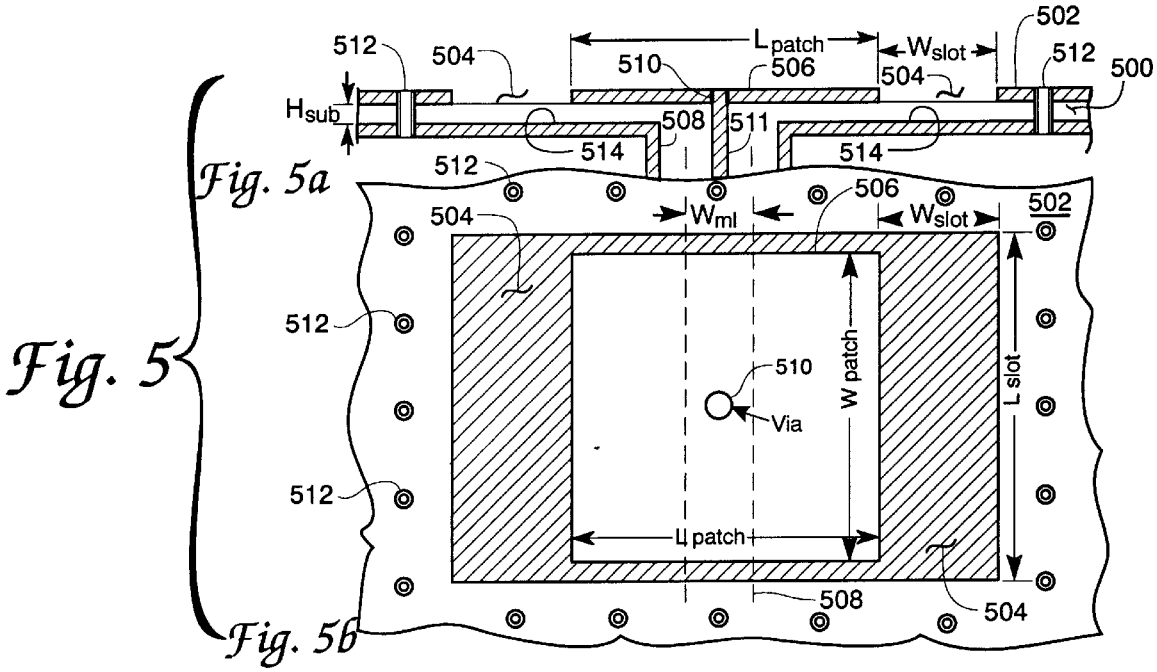

BROADBAND PATCH/SLOT ANTENNA

This application claims benefit of Provisional Application Ser. No. 60/092,230, filed Jul. 9, 1998.

RIGHTS OF THE GOVERNMENT

The invention described herein may be manufactured and used by or for the Government of the United States for all governmental purposes without the payment of any royalty.

BACKGROUND OF THE INVENTION

Several transmission line and antenna arrangements compatible with printed circuit embodiment of microwave electronic apparatus are known in the electronic arts and have found application in radar, satellite communication and other present day systems. In these systems a transmission line realized in the form of printed circuit conductors is often used to communicate radio frequency energy to or form an antenna element.

The printed circuit conductor in these embodiments may for example be arranged in the form of what is known as "stripline", an arrangement wherein a strip conductor is received between two adjacent ground planes, or alternately in the form of "microstrip" line wherein a single conductor is spaced from a single ground plane. The printed circuit conductor may also be in the form of "slot" line wherein a slot formed in one planar conductor is spaced from a second ground plane conductor. Another common arrangement for such printed circuit transmission line is known as coplanar waveguide line and is in the form of an electrically isolated signal conductor bounded laterally by adjacent ground plane conductors in a coplanar disposition.

Some of these transmission line types have also been used in configurations wherein an apparent part of one or more transmission line elements also functions as an active element portion of an antenna, an antenna coupled to the transmission line. In these arrangements the transmission line and antenna element portions may appear structurally integral however for functional and analysis purposes a segregation of functions is convenient. This combination of transmission line and antenna functions in single structure has been achieved particularly in the case of microstrip transmission lines. Unlike the case of such microstrip antennas there appears to be little reporting in the technical literature concerning wide strip coplanar waveguide lines or open ended discontinuities and their radiating properties, areas of consideration in the present invention.

This latter transmission line disposition which has been identified by the name of "coplanar waveguide" offers several advantages including its easy layout and fabrication by single layer photographic techniques and acceptable electrical losses. The ease with which coplanar transmission line of this nature can be coupled to resonators and antenna elements is also significant and approaches the topic of interest in the present invention. Perhaps the most convenient of antenna arrangements usable with coplanar waveguide transmission line is the antenna known as a "patch" antenna. Literally such antennas may consist of a printed circuit conductor area of selected and resonance-based physical size disposed at the terminal point or other selected node along a radio frequency conductor. When used with the above identified microstrip form of printed circuit transmission lines for example the patch antenna is found to be attended by several problems; the primary of which is a limited bandwidth capability. This patch antenna bandwidth often extends over only a few percent of the antenna's design frequency and gives rise to difficulty in spread spectrum communications or multiple systems use applications of the antenna. The present invention in which the patch antenna is improved-upon by combining it with a selected additional form of antenna while yet remaining in the convenient and desirable coplanar waveguide environment is believed to provide a desirable addition to the family of antennas usable in printed circuit microwave apparatus.

SUMMARY OF THE INVENTION

The present invention provides a microwave antenna of desirable wide bandwidth electrical characteristics and concurrent compatibility with the coplanar waveguide form of radio frequency transmission line.

It is an object of the present invention therefore to provide a broadband microwave antenna.

It is another object of the invention to provide a broadband antenna having compatibility with the coplanar waveguide form of transmission line and with coplanar waveguide antenna practices.

It is another object of the invention to provide a broadband microwave antenna combining desirable characteristics of two different antenna types known in the art.

It is another object of the invention to provide a broadband microwave antenna combining the characteristics of a patch antenna with those of a slot antenna.

It is another object of the invention to provide a broadband microwave antenna of the single layer or single plane type.

It is another object of the invention to improve on the multiple layer multiple plane types of antennas known in the electronic art; antennas of the types often used in the microstrip transmission line environment for example.

It is another object of the invention to provide a broadband coplanar antenna in which multiple resonances may be individually treated and tailored to achieve a desired broadband antenna characteristic.

It is another object of the invention to provide a broadband antenna in which a thirty percent usable bandwidth is achievable in for example the seven gigahertz operating frequency range.

It is another object of the invention to provide a broadband coplanar microwave antenna, easily fabricated with printed circuit and similar materials.

It is another object of the invention to provide a broadband coplanar microwave antenna usable in multiple antenna environments such as in an electronically steered radar antenna array.

It is another object of the invention to provide a broadband coplanar microwave antenna readily adapted to use in vehicles including aircraft for uses such as communications, radar and electronic warfare systems.

It is another object of the invention to provide a broadband coplanar microwave antenna capable of accurate, convenient performance modeling and characteristic tailoring.

Additional objects and features of the invention will be understood from the following description and claims and the accompanying drawings.

These and other objects of the invention are achieved by broadband combination patch and slot coplanar microwave antenna apparatus comprising the combination of:

an electrical conductor ground plane member disposed on an electrically insulating planar substrate member;

said ground plane member including a rectangular shaped electrical conductor aperture having orthogonally disposed shorter and longer aperture sides received in a ground plane interior portion;

a coplanar rectangularly shaped electrically conductive patch antenna member symmetrically received in electrical isolation within said ground plane conductor rectangular aperture on said electrically insulating planar substrate member;

said electrically conductive patch antenna member being characterized by first and second diametrically opposed radiating edge portions, of respective first and second patch antenna electrical resonance frequency characteristics and disposition adjacent respective ground plane conductor shorter aperture sides;

a first electrical slot resonator inclusive of said first electrically conductive patch antenna member first radiating edge, an adjacent ground plane aperture shorter side conductor and an intervening non-conducting exposed substrate area, said first electrical slot resonator having a first slot antenna electrical resonance frequency characteristic;

a second electrical slot resonator inclusive of said second electrically conductive patch antenna member second radiating edge, an adjacent ground plane aperture shorter side conductor and an intervening non-conducting exposed substrate area, said second electrical slot resonator having a second slot antenna electrical resonance frequency characteristic;

a transmission line conductor element coplanar received within an elongated ground plane void pathway and communicating radio frequency electrical energy among a region peripheral of said ground plane member and said electrically conductive antenna member in said rectangular shaped electrical conductor aperture.

BRIEF DESCRIPTION OF THE DRAWINGS

FIG. 4 shows a two dimensional representation of a three dimensional radiation pattern provided by a present invention antenna.

FIG. 5*a* shows an alternately fed antenna according to the invention in elevation perspective.

FIG. 5*b* shows the FIG. 5*a* antenna in plan view.

DETAILED DESCRIPTION

Figure 1:
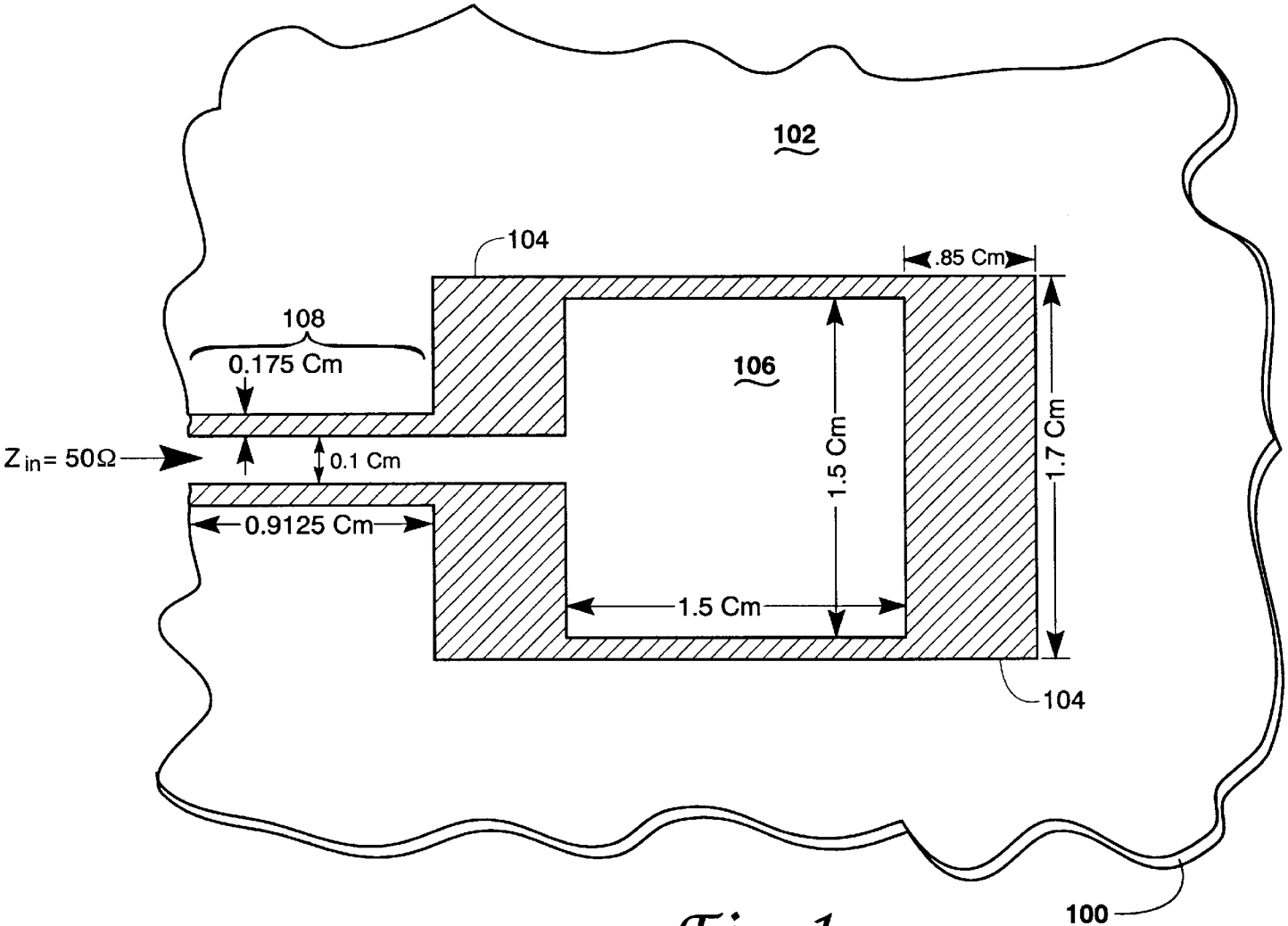
FIG. 1 shows an enlarged perspective view of a patch/slot microwave coplanar antenna according to the present invention.

FIG. 1 in the drawings shows an enlarged perspective view of a microwave coplanar waveguide antenna according to the present invention. As may be observed in the FIG. 1 drawing this present invention antenna is a combination patch and slot antenna in which this first embodiment involves a resonator element electrically coupled to a feed line by way of a radiating edge. When configured according to the dimensions shown in the FIG. 1 drawing this antenna provides a frequency response centered in the microwave spectral region and located at the specific microwave frequency of seven gigahertz. A bandwidth of about thirty percent as measured at this frequency and at the ten decibels-attenuated response points is provided. A detailed representation of this frequency response is shown in the graphic drawing of FIG. 3 and is discussed in connection with this FIG. 3 drawing. In discussing the FIG. 1 antenna its physical and compositional aspects will be considered first, followed by electrical and antenna performance-related aspects as are symbolized in the FIG. 2 drawing. The FIG. 1 antenna may be described as an antenna having an open-ended coplanar waveguide resonator. The FIG. 1 drawing should be understood to represent a metal radiating element 106 surrounded by a metal ground plane member 102 that is coplanar with the radiating element 106 but electrically insulated from this radiating element. The FIG. 1 antenna can be used for both transmitting and receiving purposes, that is, electrical energy flow into or out of the antenna is contemplated. The language communicating radio frequency electrical energy among, regions attending the antenna is used herein to indicate this either direction flow.

The FIG. 1 microwave antenna is of a coplanar waveguide type as may be embodied using printed circuit techniques and may be considered to comprise five major portions. These portions include therefore an electrically insulating substrate 100, a conductive ground plane member 102 received on the substrate 100, a ground plane member aperture 104 located in a central portion of the substrate 100, an electrically isolated radiating element 106 also received on the substrate 100 and disposed within the aperture 104 and an energy transmission line portion 108 communicating between a boundary of the substrate 100 and the interior of the ground plane member aperture 104. The energy transmission line portion 108 serves both an energy conveying and an impedance transforming function as discussed later herein.

The substrate 100 of the FIG. 1 antenna may be made from a material such as Rogers Duroid 5880 a material providing a dielectric constant, $\epsilon_1$, of 2.2. and a substrate thickness, Hsub, of 0.0794 centimeters. The Duroid material is of a polytetrafloroethylene composition and is available from Rogers Incorporated. A material other than this Duroid may be used as the FIG. 1 antenna substrate where differing electrical, physical or chemical properties are needed. Such variation may cause electrical properties to change if not accommodated by compensating changes in other parts of the antenna as will be appreciated by those skilled in the electrical and antenna arts.

The ground plane member 102 and the radiating element 106 of the FIG. 1 antenna may be fabricated of such conductive materials as aluminum, gold, silver, copper and brass or other metals however for most uses of the antenna copper or copper alloyed or plated with another material is to be preferred. According to one aspect of the invention the use of copper along with photographic-based copper removal techniques as are commonly used in the printed circuit art are preferred in fabricating the antenna. In the herein disclosed arrangement of the invention this copper is provided with a thickness of 0.0007 inch ($0.7\times10^{-3}$ inch or $1.8\times10^{-3}$ centimeter), a value which may be varied with the use of accommodating changes in other elements of the antenna or with the acceptance of slight electrical characteristics alteration. For the seven gigahertz embodiment of the antenna the radiating element 106 may have length and width dimensions, $l_{patch}$ and $w_{patch}$ that are each one and one half centimeters. These dimensions and others appropriate for the seven gigahertz antenna appear in the FIG. 1 drawing.

Figures 2, 2A, 2B:
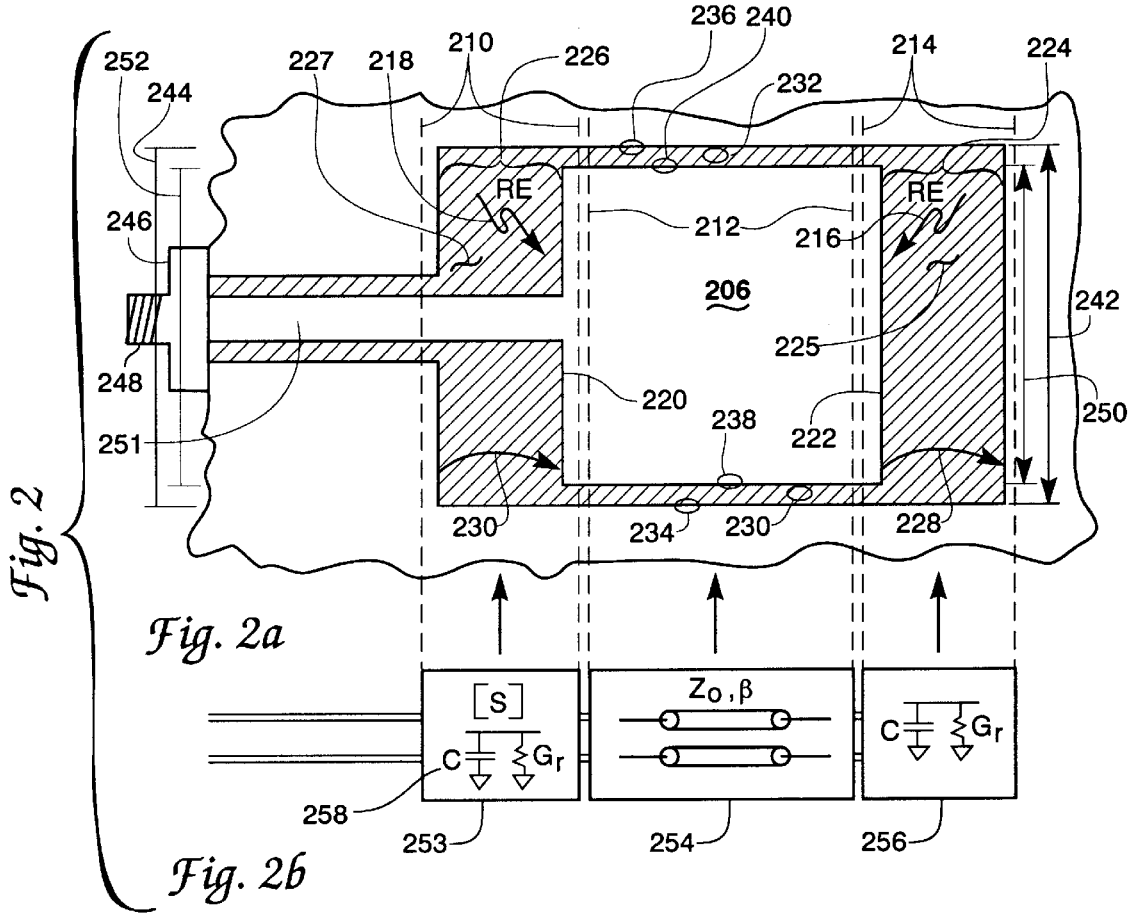
FIG. 2*a* shows additional physical and electrical details of an antenna according to the present invention.
FIG. 2*b* shows transmission line model electrical network components and their relationship to portions of the FIG. 2*a* antenna.

FIG. 2 in the drawings includes the views of FIG. 2*a* and FIG. 2*b* and shows additional details of the FIG. 1 antenna, especially details relating the antenna's electrical properties. In the FIG. 2*a* drawing for example several parts of the antenna are traversed by the dotted line pairs 210, 212 and 214 used to indicate a degree of functional correspondence between antenna physical portions and the equivalent circuit electrical components represented in the FIG. 2*b* drawing. As indicated by the "RE" symbols at 216 and 218, the leftmost and rightmost edges 220 and 222 of the FIG. 2 antenna radiating element 206 also serve as principle radiator edges during operation of the antenna Representative electric field vectors resulting from microwave radio frequency energization of these radiator edges 220 and 222 are shown at 228 and 229 in the FIG. 2 drawing. It may be appreciated that these vectors are additive in nature in directions orthogonal of the FIG. 2 drawing plane and thereby result in electrical field patterns extending above and below the plane of the FIG. 2 drawing during operation of the antenna. Such vectorial addition is enabled by the length of the patch element 206 being about one half of a wavelength at the operating frequency of the antenna.

Even though the FIG. 1 and FIG. 2 antenna and especially the radiating element 206 may at first blush be considered to resemble a conventional patch antenna, the spacings shown at 224 and 226 in the FIG. 2 antenna give rise to additional slot antenna-related aspects which are significant in achieving the desired broadband antenna frequency response characteristics, i.e., the characteristics needed for many present day military and related uses. The relatively large spacings shown at 224 and 226 may in fact be considered to provide slot antenna resonant cavities 225 and 227 cavities involving the antenna rightmost and leftmost principle radiator edges 220 and 222. By way of these cavities 225 and 227, and especially in view of the tuned lengths 242 and 244 of the cavities, the FIG. 1 and FIG. 2 antennas are in fact provided with combined patch and slot antenna characteristics considerably broadened and improved over those achievable with a simple patch antenna element alone. Lengths of the two slots 242 and 244 may be longer or shorter than the dimensions 250 and 252 for the patch element 206 in order to select the slot resonance frequencies for increasing the bandwidth of the antenna.

Notably the FIG. 1 and FIG. 2 antennas provide largely unfettered and independent access to the selection of resonant frequencies for each of the cavities 225 and 227 and for the patch element 206. In the latter patch element case the selection of resonant frequency is accomplished by way of selecting lengths 250 and 252 to achieve either the coincident or the slightly different resonances desired. In the case of the cavities 225 and 227 the lengths 242 and 244 are selected to achieve either the coincident or the slightly different resonances desired with the cavity width remaining constant. Through this independence of three frequencies relevant to the FIG. 1 and FIG. 2 antennas it is possible to control the overall antenna bandwidth characteristics.

Intermediate the edge radiators 220 and 222 the body of the patch element 206 of the FIG. 2 antenna acts as a transmission line component in communicating radio frequency energy from the transmission line-connected edge 220 to the distal edge 222. This transmission line involves the ground plane conductor edges at 234 and 236, the conductor gap regions at 230 and 232 and the radiating element edges at 238 and 240. In contrast with the electrical field pattern established by the radiators 220 and 222 the electrical field vectors extending across the gap regions 230 and 232 are in phase opposition and create no electrical field patterns nor radiation patterns of the type shown in FIG. 4. This results from the field distribution in the coplanar-waveguide transmission line structure wherein electrical field vectors are directed from the central conductor, i.e., the patch element 206, to the two ground planes 234 and 236.

At 251 in the FIG. 2*a* drawing is shown a transmission line element used to communicate radio frequency energy from an antenna input port, represented by the electrical connector 246 and its threaded receptacle 248, to the radiating element 206. It is notable that this radio frequency energy communication is accomplished to the edge-disposed radiator 220 in the FIG. 2 antenna and that this edge radiator represents a node of relatively high electrical impedance. To accomplish such energy flow requires that the transmission line element 251 also serve as an impedance transformer and alter the relatively low impedance of the transmission line at the connector 246 to the higher impedance of the edge radiator. In practice this impedance transformation can be accomplished with bandwidth sufficient for the present purposes by selecting a suitable length and characteristic impedance (which is controlled by choice of the strip 251 width) for the transmission line element 251. Alternately impedance matching arrangements known in the art of distributed radio frequency or microwave circuits may be used in place of this coplanar waveguide arrangement without altering the novelty of the described antenna.

The FIG. 2*b* portion of FIG. 2 shows pictorial representations of electrical components and mathematical variables useful in quantitatively describing the antenna portions intercepted by each respective pair of the vertical dotted line pairs 210, 212 and 214. These representations are based on use of a transmission line model for representing the antenna element 206 as has been described by the herein named inventors in the paper "ELECTROMAGNETIC-ANN MODELS FOR DESIGN OF CPW PATCH ANTENNAS" presented at the Institute of Electrical and Electronic Engineers International Symposium on Antennas and Propagation held Jun. 21–26, 1998 at Atlanta, Ga., a paper which is hereby incorporated by reference herein. In the block 253 of the FIG. 2*b* drawing herein for example, there is shown an equivalent circuit portion 258 and a mathematical matrix variable, S, usable to characterize the portion of the antenna appearing between the dotted line pair 210, i.e., to characterize an input radiation edge and transmission line portion of the FIG. 2*a* antenna. According to this characterization the capacitive component C, represents an edge capacitance, the resistive component $G_r$ represents a radiation conductance appropriate to the edge-disposed radiator 220 and the variable S represents remaining electrical characterization of the region 227.

In a similar manner the two conductor transmission line depicted in the box 254 of FIG. 2*b* represents the transmission line of the radiating element 206, the transmission line attending the conductor gap regions at 230 and 232 discussed above. In the box 256 of FIG. 2*b* are similarly shown a capacitive element C and a resistive element $G_r$ representative of the edge-disposed radiator 220 in the manner discussed above for the box 253 components.

Figure 3:
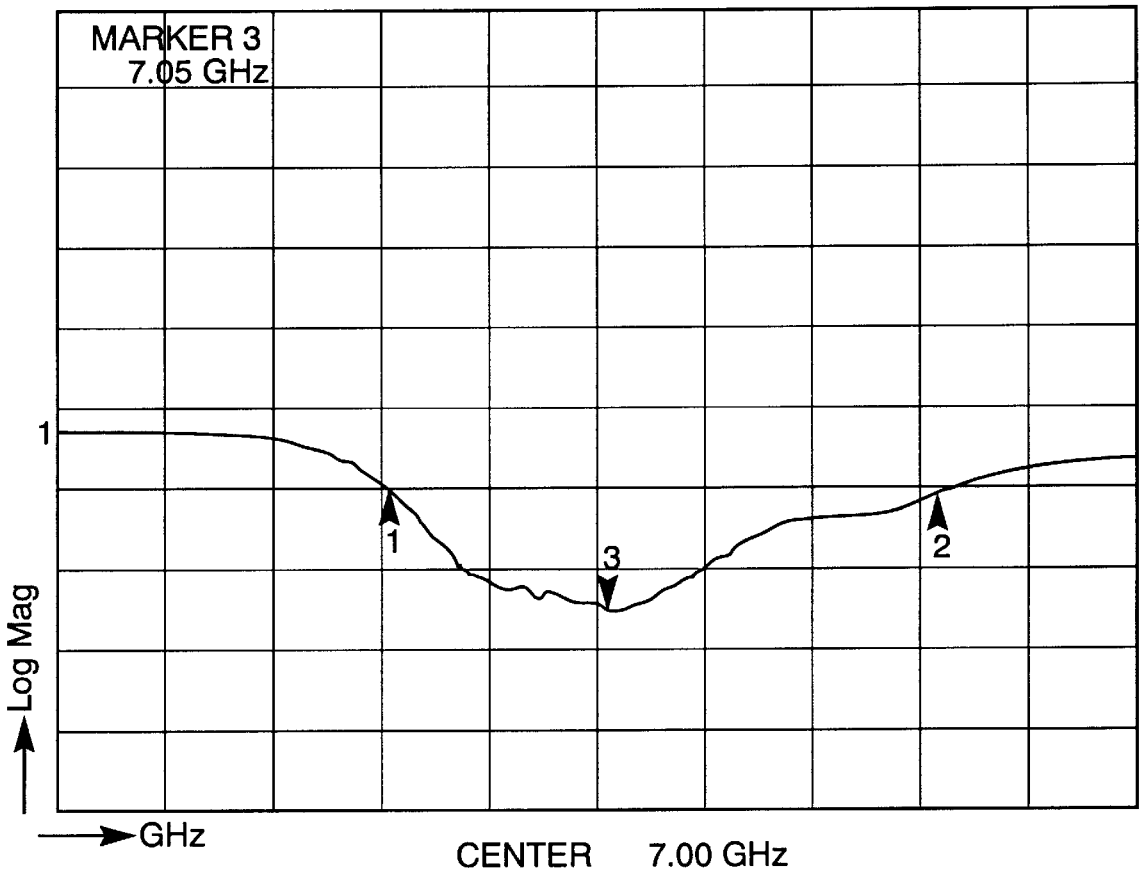
FIG. 3 shows a frequency response curve for an antenna according to the invention.

FIG. 3 in the drawings shows a frequency versus the reflected signal amplitude plot for the seven gigahertz antennas shown in the FIG. 1 and FIG. 2 drawings. The FIG. 3 data is vertically logarithmic in nature with each vertical division representing a ten decibels signal strength change and each horizontal division representing one half gigahertz of frequency change. The markers 1, 2, and 3 in the FIG. 3 drawing represent frequencies of 6.05 gigahertz, 8.575 gigahertz and 7.05 gigahertz respectively. The relative signal strengths at these locations are −10.415 decibels, −10.451 decibels and −25.283 decibels respectively and are measured with respect to the radio frequency power incident on the antenna when fed through the connector 248. The FIG. 3 drawing may be obtained from measurement using a microwave network analyzer or computed using a microwave network simulator such as the Hewlett Packard Microwave Design System in the form of version 7.00.00; this is available from Hewlett-Packard Company, Santa Rosa, Calif., 1996. The vertical axis in FIG. 3 represents $S_{11}$, the reflection coefficient at the input port of the antenna. The frequency range over which $S_{11}$ is better than −10 dB is usually accepted as the operating frequency range of an antenna.

FIG. 4 in the drawings shows a typical radiation pattern provided by an antenna of the present invention type in a simulated three dimensional representation. In the FIG. 4 drawing the horizontal and vertical directions represent distance and absolute value of field strength respectively. Specific values relevant to the FIG. 4 drawing include a directivity of 5.8 dB, a mismatch loss of −0.07 dB, an efficiency of 94.8 percent, a total radiated power of 0.009 watt, average radiated power of 0.007 watt, input power at ports of 0.009 watt. Although these recited values have relevance with respect to the FIG. 4 drawing and modeling of the antenna, this drawing is primarily used to show a typical broadside radiation pattern for an antenna made according to the invention. The disclosure of specific numbers is in addition not intended as a limitation of the invention.

The combined patch and slot antenna of the present invention may be modified from the radiating edge-fed form shown in the FIG. 1 and FIG. 2 drawings to an arrangement involving a non-coplanar feeding of the patch element by a metallized via as is shown in FIG. 5 of the drawings. In the FIG. 5 drawing the view of FIG. 5*a* shows the metallized via-fed antenna in elevation or cross section while the view of FIG. 5*b* shows the antenna in a plan view. The FIG. 5 antenna includes an electrically insulating substrate 500, a conductive ground plane member 502 received on the substrate 500, a ground plane member aperture located in a central portion of the substrate 500, the aperture including the radiating slots 504, an electrically isolated radiating element 506 also received on the substrate 500 and disposed within the aperture contiguous the slots 504 and an energy transmission line portion 508 communicating between a boundary of the substrate 500 and the interior of the ground plane member aperture.

In the FIG. 5 antenna a central conductor 511 of a coaxial energy transmission line portion 508 is connected with a lowered impedance central portion of the radiating element 506 by way of a metal via 510 passing through each of the electrically insulating substrate 500 and the radiating element 506 at a central location of the radiating element 506. The FIG. 5 antenna may also be viewed as being a section of a grounded coplanar waveguide consisting of elements 506, 512 and 514 along with the gaps 504, connected to a coaxial transmission line comprised of elements 508 and 511. Via connections as shown at 512 are used around the aperture 504 to connect the ground plane member 502 with the remaining grounded conductor of this coplanar waveguide transmission line 514.

The slot and patch dimensions discussed above in connection with the FIG. 1 and FIG. 2 antenna are also relevant to the FIG. 5 antenna. The energy transmission line portion 508 may serve in both an energy conveying and an impedance transforming function through appropriate physical dimension selection in the FIG. 5 antenna. The FIG. 5 antenna is deemed a coplanar waveguide antenna notwithstanding use of a non coplanar transmission line since the antenna, even though not the feedline, is of coplanar configuration with respect to a surrounding ground plane member. A coaxially fed coplanar waveguide patch antenna is desirable for use when radiation field is desired on only one side of the antenna. Such antennas are useful for example when mounted on outer surface of an aircraft or spacecraft.

Figure 6:
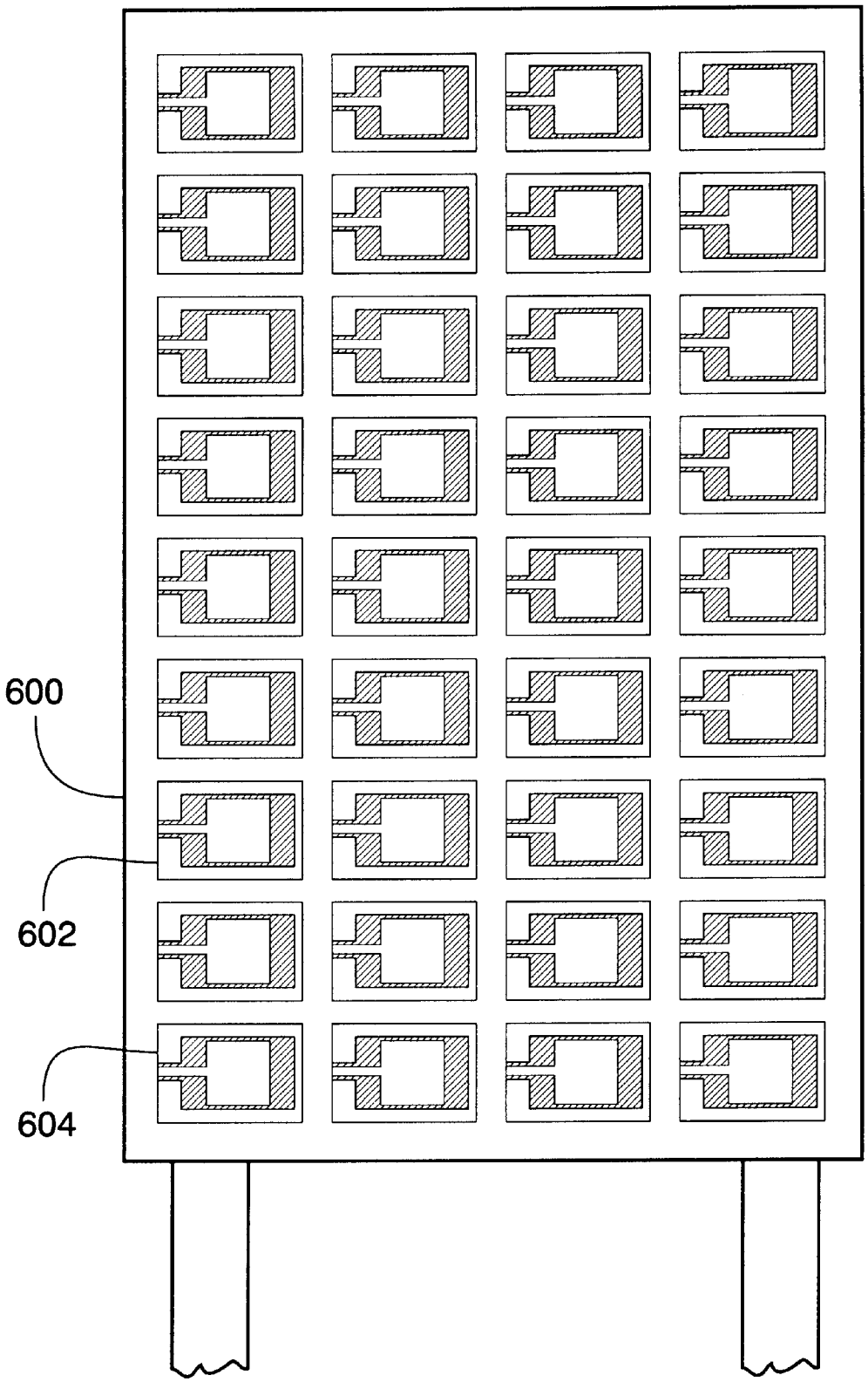
FIG. 6 shows a plurality of the FIG. 1 and FIG. 2 antennas arranged into a large antenna array.

FIG. 6 in the drawings shows a plurality of the FIG. 1 and FIG. 2 antennas arranged into a large antenna array as may be used in the electronically steerable antenna of a radar system for example. In the FIG. 6 array 600, individual antennas of the FIG. 1 and FIG. 2 type are indicated at 602 and 604 and are disposed at regular intervals in both the horizontal and vertical element directions of the array 600. These individual antennas are presumed coupled to a common transmitter/receiver apparatus, which is not shown, by way of coupling networks providing for selected and variable signal phase and amplitude relationships between individual antenna signals in order to achieve the electronic steering function.

Figure 7:
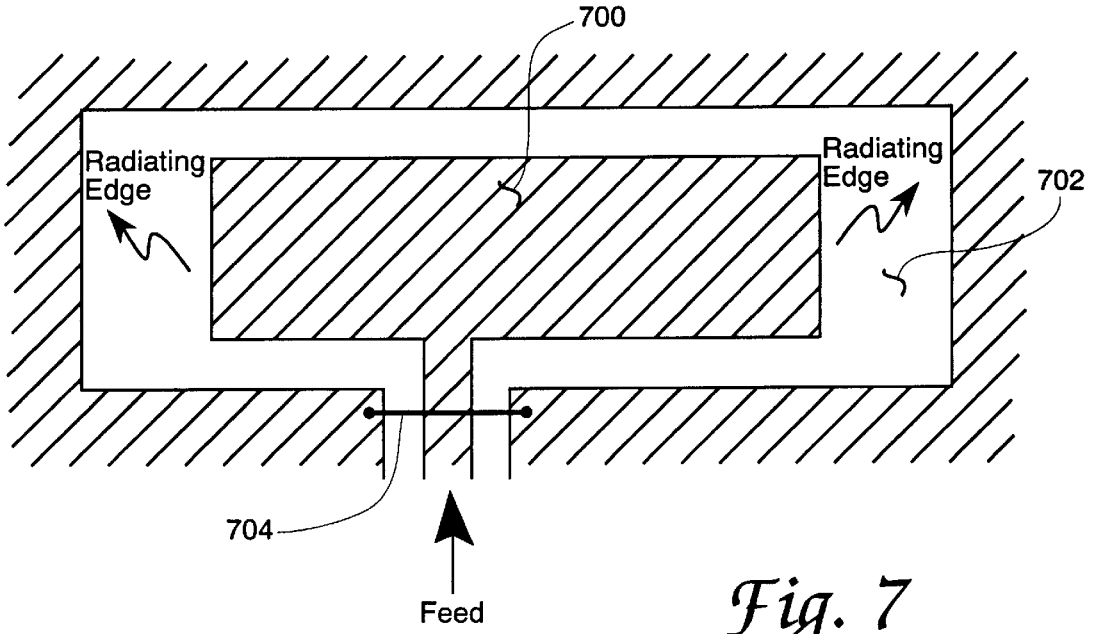
FIG. 7 shows an additional antenna and transmission line coupling arrangement usable with the present invention.

FIG. 7 in the drawings shows yet another feed line arrangement usable with the present invention antenna, an arrangement wherein a coplanar waveguide antenna element is coupled to a coplanar waveguide transmission line. In the FIG. 7 drawing the patch element appears at 700 and the ground plane aperture is shown at 702. An air bridge element 704 is sometimes desirable in the FIG. 7 antenna configuration in order to maintain the two ground plane areas adjacent the transmission line conductor in equipotential status. The FIG. 7 apparatus is somewhat intermediate that of the FIG. 1 and FIG. 6 antennas with respect to input impedance.

Numeric modeling enabling the achievement of specific coplanar waveguide antennas made in accordance with the present invention may be accomplished using relatively simple network models; models such as the transmission line model used for microstrip patch antennas. A transmission line model for coplanar waveguide antennas based on artificial Neural Network models for coplanar waveguide open end, coplanar waveguide and T junction antennas has been explored by the present inventors. This work is an extension of the procedure disclosed in the earlier technical journal article of Paul Watson and K. C. Gupta appearing in the Institute of Electrical and Electronic Engineers Transactions on Microwave Theory Technology, volume 44 pages 2495–2503 and is additionally discussed in the summary of a presentation made at the International Union of Radio Science symposium at Montreal, Canada, July 1997, "Transmission Line Model for CPW Antennas Using ANN Modeling Approach" by K. C. Gupta and Paul Watson. Each of the technical journal article identified herein is hereby incorporated by reference herein.

The present invention therefore provides a combination microwave antenna having a new coplanar relationship with its attending ground plane member. The antenna combines the bandwidth characteristics of the patch and slot antennas in an advantageous manner and is easily fabricated through use of for example printed circuit processing. The antenna achieves a frequency bandwidth in at least the thirty percent range partially through achieving independent access to a plurality of characteristic-influencing resonance mechanisms. In its simplest form the antenna provides a bidirectional field pattern; a pattern which may be altered to unidirectional form using the grounded coplanar line configuration of FIG. 5. The antenna appears usable in a number of present day broadband applications including plural antenna steerable arrays and antennas disposed in either earthbound, airborne or space deployed microwave systems.

While the apparatus and method herein described constitute a preferred embodiment of the invention, it is to be understood that the invention is not limited to this precise form of apparatus or method and that changes may be made therein without departing from the scope of the invention which is defined in the appended claims.

What is claimed is:

1. Broadband combination patch and slot coplanar microwave antenna apparatus comprising the combination of:

an electrical conductor ground plane member disposed on an electrically insulating planar substrate member;

said ground plane member including a rectangular shaped electrical conductor aperture having orthogonally disposed shorter and longer aperture sides received in a ground plane interior portion;

a coplanar rectangularly shaped electrically conductive patch antenna member received in electrical isolation, with smaller and larger pairs of spacings respectively from said longer and said shorter aperture sides, within said ground plane conductor rectangular aperture on said electrically insulating planar substrate member;

said electrically conductive patch antenna member being characterized by first and second diametrically opposed radiating edge portions, of respective first and second patch antenna electrical resonance frequency characteristics and disposition adjacent respective ground plane conductor shorter aperture sides;

a first electrical slot resonator inclusive of said first electrically conductive patch antenna member first radiating edge, an adjacent ground plane aperture shorter side conductor and an intervening non-conducting exposed substrate area of said larger patch antenna member to ground plane conductor rectangular aperture spacing, said first electrical slot resonator having a first slot antenna electrical resonance frequency characteristic;

a second electrical slot resonator inclusive of said second electrically conductive patch antenna member second radiating edge, an adjacent ground plane aperture shorter side conductor and an intervening non-conducting exposed substrate area of said larger patch antenna member to ground plane conductor rectangular aperture spacing, said second electrical slot resonator having a second slot antenna electrical resonance frequency characteristic;

a transmission line conductor element received within an elongated ground plane void pathway and communicating radio frequency electrical energy among a region peripheral of said ground plane member and said electrically conductive patch antenna member in said rectangular shaped electrical conductor aperture.

2. The broadband combination patch and slot coplanar microwave antenna apparatus of claim 1 wherein said first and second electrically conductive patch antenna member electrical resonance frequency characteristics are of the same electrical resonance frequency.

3. The broadband combination patch and slot coplanar microwave antenna apparatus of claim 2 wherein said first and second electrically conductive patch antenna member same electrical resonance frequency, said first slot antenna electrical resonance frequency and said second slot antenna electrical resonance frequency comprise at least two different resonance frequencies.

4. The broadband combination patch and slot coplanar microwave antenna apparatus of claim 3 wherein said first and second electrically conductive patch antenna member same electrical resonance frequency, said first slot antenna electrical resonance frequency and said second slot antenna electrical resonance frequency comprise three different resonance frequencies.

5. The broadband combination patch and slot coplanar microwave antenna apparatus of claim 4 wherein said first and second electrically conductive patch antenna member same electrical resonance frequency, said patch antenna electrical resonance frequency and said second slot antenna electrical resonance frequency are respectively a lowest microwave frequency, an intermediate microwave frequency and a highest microwave frequency.

6. The broadband combination patch and slot coplanar microwave antenna apparatus of claim 1 wherein said rectangularly shaped electrically conductive patch antenna member is square in shape and has dimensions selected in response to antenna operating frequency.

7. The broadband combination patch and slot coplanar microwave antenna apparatus of claim 6 wherein said ground plane member rectangular shaped electrical conductor aperture has a shorter aperture side width dimension, parallel to said patch antenna radiating edge portion, selected in response to antenna operating frequency.

8. The broadband combination patch and slot coplanar microwave antenna apparatus of claim 7 wherein said antenna has a center frequency and ten decibels down frequencies determined by selectively dispersed resonant frequencies in said electrically conductive patch antenna member and said first and second slot resonators.

9. The broadband combination patch and slot coplanar microwave antenna apparatus of claim 8 wherein said antenna has measured center frequency and ten decibels down frequencies of seven and five one hundredths gigahertz, six and five one hundredths gigahertz and eight and five hundred seventy five thousandths gigahertz respectively.

10. The broadband combination patch and slot coplanar microwave antenna apparatus of claim 1 wherein said transmission line conductor element received within said elongated ground plane void pathway comprises a conductor disposed perpendicular of said first radiating edge portion and connecting with a lengthwise central point of said first radiating edge portion.

11. The broadband combination patch and slot coplanar microwave antenna apparatus of claim 1 wherein said transmission line conductor element is disposed on an opposite side of said electrically insulating planar substrate member with respect to said electrically conductive patch antenna member and is connected with said electrically conductive patch antenna member by a conductor passing through said electrically insulating planar substrate member.

12. The broadband combination patch and slot coplanar microwave antenna apparatus of claim 11 wherein said transmission line comprises a coplanar waveguide line and further including a plurality of conductive via elements connecting one conductor of said transmission line through said electrically insulating planar substrate member with said ground plane member.

13. The broadband combination patch and slot coplanar microwave antenna apparatus of claim 1 wherein said antenna is one of a plurality of similar antennas disposed in a phased array of antennas.

14. The method of fabricating a broadband planar microwave antenna comprising the steps of:

tuning physical dimensions of a coplanar ground plane-surrounded rectangular patch antenna element portion of said coplanar microwave antenna to resonate at patch antenna first resonant frequencies within an operating frequency band selected for said coplanar microwave antenna;

said tuning step achieving first and second rectangular patch antenna element radiating edge portions of tuning-selected length on opposed sides of said rectangular patch antenna element portion;

attuning different physical spacings, disposed coplanar with and intermediate each of said first and second rectangular patch antenna element radiating edge portions and paralleling adjacent ground plane edge portions, and forming two slot antenna having second and third resonant frequencies, frequencies within said operating frequency band selected for said coplanar microwave antenna;

connecting a transmission line radio frequency energy-conveyance conductor to a central portion of said ground plane-surrounded rectangular patch antenna element radiating edge portion.

15. The method of fabricating a broadband planar microwave antenna of claim 14 wherein said transmission line radio frequency energy-conveyance conductor connects with said rectangular patch antenna element radiating edge portion and comprises physical dimensions generating, within said operating frequency band, a relatively low, coaxial transmission line-compatible, input impedance at an energy input end thereof.

16. The method of fabricating a broadband planar microwave antenna of claim 14 further including the step of selecting physical dimensions for portions of said rectangular patch antenna element intermediate said radiating edge portions, adjacent portions of said ground plane and spacings intermediate thereto for efficient radio frequency energy transmission intermediate said radiating edge portions.

17. Combination patch element and slot element coplanar microwave antenna apparatus comprising the combination of:

a patch antenna element of orthogonal sides, approximately half wavelength physical dimensions and dual opposed extremity radiating edges disposed on a coplanar element plane within a surrounding coplanar ground plane member void;

first and second slot antenna conductor-absence regions, also of approximately half wavelength physical dimension along a greatest length thereof, disposed intermediate each of said opposed extremity radiating edges of said patch antenna element and adjacent ground plane member edges on said co-planar element plane;

transmission line conductor and spacing elements of differing spacing element length from said first and second slot antenna conductor absence regions connecting with radio frequency energy input and radio frequency energy output sides of one patch antenna element radiating edge and communicating radio frequency energy to said first radiating edge and thence to said second radiating edge;

electric field vectors formed across said first and second slot antenna conductor-absence regions, extending orthogonal of said slot antenna half wavelength physical dimension, being vectorially additive and supportive of complementing radiation field patterns extending outward from said coplanar elements plane;

electric field vectors formed across said transmission line spacing elements intermediate said patch antenna element radiating edges being vectorially subtractive and non-radiating and non-contributive to said radiation field patterns.

18. The combination patch element and slot element coplanar microwave antenna apparatus of claim 17 wherein said transmission line conductor and spacing elements communicating radio frequency energy to said first radiating edge extend from a peripheral region of said ground plane member into said ground plane member void in coplanar dispose with said patch antenna element, said ground plane and said slot antenna conductor-absence regions.

* * * * *